US005769131A

United States Patent [19]

Whitlock et al.

[11] Patent Number: 5,769,131

[45] Date of Patent: Jun. 23, 1998

[54] SEAM DESIGN FOR A DRYER FABRIC

[75] Inventors: Sharon K. Whitlock, Rochester, Wash.; Michael J. Josef, Greenville, S.C.

[73] Assignee: Albany International Corp., Albany, N.Y.

[21] Appl. No.: 857,298

[22] Filed: May 16, 1997

[51] Int. Cl.[6] ..... D03D 13/00; D03D 15/00

[52] U.S. Cl. ..... 139/383 AA; 442/206; 428/58; 162/904

[58] Field of Search ..... 139/383 AA; 442/205, 442/206, 207; 428/58; 162/904

[56] References Cited

U.S. PATENT DOCUMENTS

| | | | |
|---|---|---|---|
| 4,476,902 | 10/1984 | Westhead | 139/383 AA |
| 4,824,525 | 4/1989 | Penven | 139/383 AA |
| 5,503,196 | 4/1996 | Josef et al. | 139/383 AA |
| 5,601,120 | 2/1997 | Kuckart et al. | 139/383 AA |

*Primary Examiner*—Andy Falik
*Attorney, Agent, or Firm*—Kane, Dalsimer, Sullivan, Kurucz, Levy, Eisele and Richard, LLP

[57] ABSTRACT

An on-machine-seamable papermakers' fabric having a smooth surface and a prolonged life includes flat machine-direction yarns which define the upper and lower surfaces thereof. The fabric has two layers of cross-machine direction yarns, each of which is interwoven with the flat machine-direction yarns. Other machine-direction yarns, of round cross section, weave with the cross-machine-direction yarns in the two layers to bind the two layers together. The knuckles of these round machine-direction yarns are within the fabric with respect to the planes defined by the flat machine-direction yarns, and, and a consequence, are less susceptible to degradation by heat and abrasion. The papermakers' fabric is seamed into endless form during installation on a paper machine. At one of the two ends of the fabric, seaming loops are formed by the round machine-direction yarns. At the other of the two ends, seaming loops are formed by the flat machine-direction yarns. The seaming loops are interdigitated with one another when the two ends of the fabric are brought together during installation on the paper machine, defining a passage through which a seaming pin or pintle may be directed to join the two ends to one another.

38 Claims, 12 Drawing Sheets

SEAM DESIGN FOR A DRYER FABRIC

BACKGROUND OF THE INVENTION

1. Field of the Invention

The present invention relates to the papermaking arts. More specifically, the present invention relates to a papermakers' fabric for use on the dryer section of a paper machine, such a fabric being commonly referred to as a dryer fabric. In particular, the present invention comprises an improved seam design for such a fabric.

2. Description of the Prior Art

During the papermaking process, a fibrous web is formed by depositing a fibrous slurry on a forming fabric in the forming section of a paper machine. A large amount of water drains from the slurry through the forming fabric during this process, leaving a fibrous web behind on its surface.

The newly formed fibrous web is then transported from the forming section to a press section, which includes a series of press nips. The fibrous web passes through the press nips supported by a press fabric, or, as is often the case, between two press fabrics. In the press nips, the fibrous web is subjected to compressive forces which squeeze water therefrom. This water is accepted by the press fabric or fabrics and, ideally, does not return to the sheet produced by compressing the fibrous web.

The sheet finally continues to a dryer section comprising at least one series of rotatable dryer drums or cylinders which are heated from within, usually by steam. The sheet follows a serpentine path sequentially around each in the series of drums, guided by one or more dryer fabrics, which hold the sheet closely against the surfaces of the drums. The heated drums reduce the water content of the web to a desirable level through evaporation.

The surface properties of the fabrics used in the forming and press sections of the paper machine have a direct bearing on the surface properties of the paper being produced. This is also true in the dryer section, where, as stated above, one or more dryer fabrics hold the paper sheet closely against the surfaces of the heated dryer cylinders. To promote drying efficiency by increasing the surface area of the dryer fabric directly holding the paper sheet against the cylinders, and to reduce the marking of the paper sheet by the fabric, dryer fabrics are typically woven to have surfaces which are as smooth as possible. In recent years, one approach taken to provide dryer fabrics with such surfaces has been to include flat monofilament yarns in their woven structures.

While it is indeed clear that the inclusion of flat monofilament yarns on the paper-contacting surfaces of a dryer fabric increases the area of direct contact between fabric and dryer cylinder, and therefore between web and dryer cylinder, such fabrics suffer from the drawback of being susceptible to wrinkling both during in-house processing and after installation on the dryer section of a paper machine. This is particularly so when the flat monofilament yarns are next, or contiguous, to one another on the surface of the dryer fabric.

U.S. Pat. No. 5,503,196 to Josef et al., which is commonly assigned with the present application, shows a dryer fabric which includes flat monofilament yarns, but which is woven in a manner that leaves it less susceptible to wrinkling. The flat monofilament yarns are not woven contiguously, but are separated from one another by yarns of circular cross section.

More particularly, U.S. Pat. No. 5,503,196, entitled "Papermakers Fabric Having a System of Machine-Direction Yarns Residing Interior of the Fabric Surfaces", shows a papermakers' fabric having smooth upper and lower surfaces. Flat machine-direction (MD) monofilament yarns define the upper and lower surfaces. The fabric has two layers of cross-machine-direction (CD) monofilament yarns of circular cross section, those of one layer being interwoven with the flat MD monofilament yarns on the upper surface, and those of the other layer being interwoven with the flat MD monofilament yarns on the lower surface. Other MD yarns, monofilaments of circular cross section, weave with the CD yarns in the two layers to bind the two layers together. The knuckles formed when these round MD monofilament yarns interweave with the CD yarns are within the fabric relative to the planes defined by the flat MD monofilament yarns on the upper and lower surfaces. As a consequence, the knuckles are less susceptible to degradation by heat and abrasion. The round MD monofilament yarns are used to form seaming loops at the ends of the fabric.

In addition to having non-contiguous flat MD monofilament yarns, and thereby being less susceptible to wrinkling, the fabric has a longer potential life on a paper machine because the round MD monofilament yarns used to seam the fabric are protected from contact with elements of a paper machine by the flat MD monofilament yarns. The papermakers' fabric has proven to be particularly useful as a dryer fabric on the dryer section of a paper machine.

The present invention is an improvement upon that disclosed and claimed in U.S. Pat. No. 5,503,196. In the present invention, the flat MD monofilament yarns are used to form loops for seaming at least at one of the two ends of the fabric, so that the seams will present less of a discontinuity on the surface of the papermakers' fabric than that obtained with the seam shown in U.S. Pat. No. 5,503,196.

SUMMARY OF THE INVENTION

Accordingly, the present invention is a dryer fabric, although it may find application in any of the forming, press and dryer sections of a paper machine.

As such, the present invention is an on-machine-seamable papermakers' fabric for the forming, press and dryer sections of a paper machine. The fabric includes a first layer and a second layer of cross-machine-direction (CD) yarns. Interwoven with the CD yarns are a first system of machine-direction (MD) yarns and a second system of MD yarns.

The MD yarns in the first system of MD yarns are interwoven with the CD yarns in the first and second layers in a duplex weave and bind the first and second layers together.

The MD yarns in the second system weave with the CD yarns in either the first or second layers. Specifically, some of the MD yarns in the second system weave with the CD yarns in the first layer, while the remainder of the MD yarns in the second system weave with the CD yarns in the second layer.

The MD yarns in the second system define the upper and lower surfaces of the fabric, and may be flat yarns having a substantially rectangular cross section. On the other hand, the MD yarns of the first system reside within the fabric with respect to its upper and lower surfaces. In other words, the knuckles formed where the MD yarns of the first system weave over (or under) the CD yarns of the first (or second) layer are interior of the surface planes formed by the MD yarns of the second system.

The on-machine-seamable papermakers' fabric has a first end and a second end which are joinable to one another during the installation of the fabric on a paper machine to place the fabric into the form of an endless loop thereon. The first end has a plurality of first seaming loops formed by MD yarns of the first system of MD yarns. The second end has a plurality of second seaming loops formed by MD yarns of the second system of MD yarns. The first seaming loops at the first end are interdigitated with the second seaming loops at the second end, when the first and second ends are brought together on the paper machine, defining a passage through which a pintle is directed to join the first and second ends together to complete the installation of the fabric on a paper machine.

The CD yarns of the first layer may be in a vertically stacked, paired relationship with the CD yarns of the second layer. Further, the MD yarns of the second system may be in a vertically stacked, paired relationship with one another. That is to say, those MD yarns of the second system weaving with the CD yarns of the first layer may be vertically stacked over those MD yarns of the second system weaving with the CD yarns of the second layer with which they are paired. Finally, a pair of MD yarns of the first system may be between each stacked pair of MD yarns of the second system. As such, pairs of MD yarns in the first system may alternate with vertically stacked pairs of MD yarns of the second system widthwise across the fabric.

The present invention will now be described in more complete detail with frequent reference being made to the several drawing figures identified below.

DETAILED DESCRIPTION OF THE PREFERRED EMBODIMENTS

Figure 1:
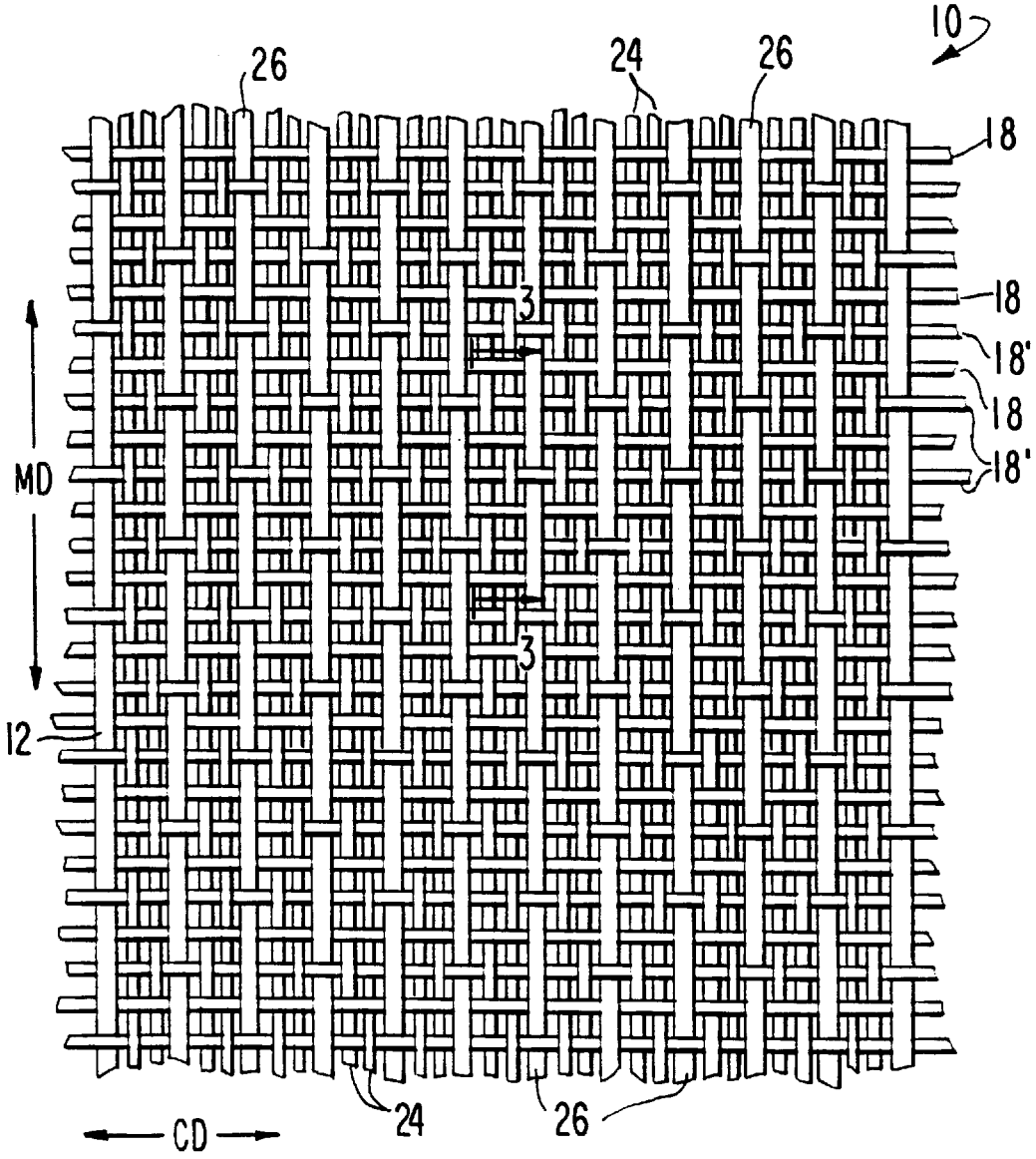
FIG. 1 is a plan view of the upper surface of the papermakers' fabric on which the present invention may be practiced.

Turning now more specifically to these figures, FIG. 1 is a plan view of the upper surface 12 of the papermakers' fabric 10 on which the present invention may be practiced. In FIG. 1, the machine direction (MD) and cross-machine direction (CD) are as indicated. While only the upper surface 12 is visible, it will become apparent from the description to follow that the lower surface 14 will have a similar appearance. The spacing between adjacent yarns of the papermakers' fabric 10 in this and other figures is exaggerated for the sake of clarity.

Figure 2:
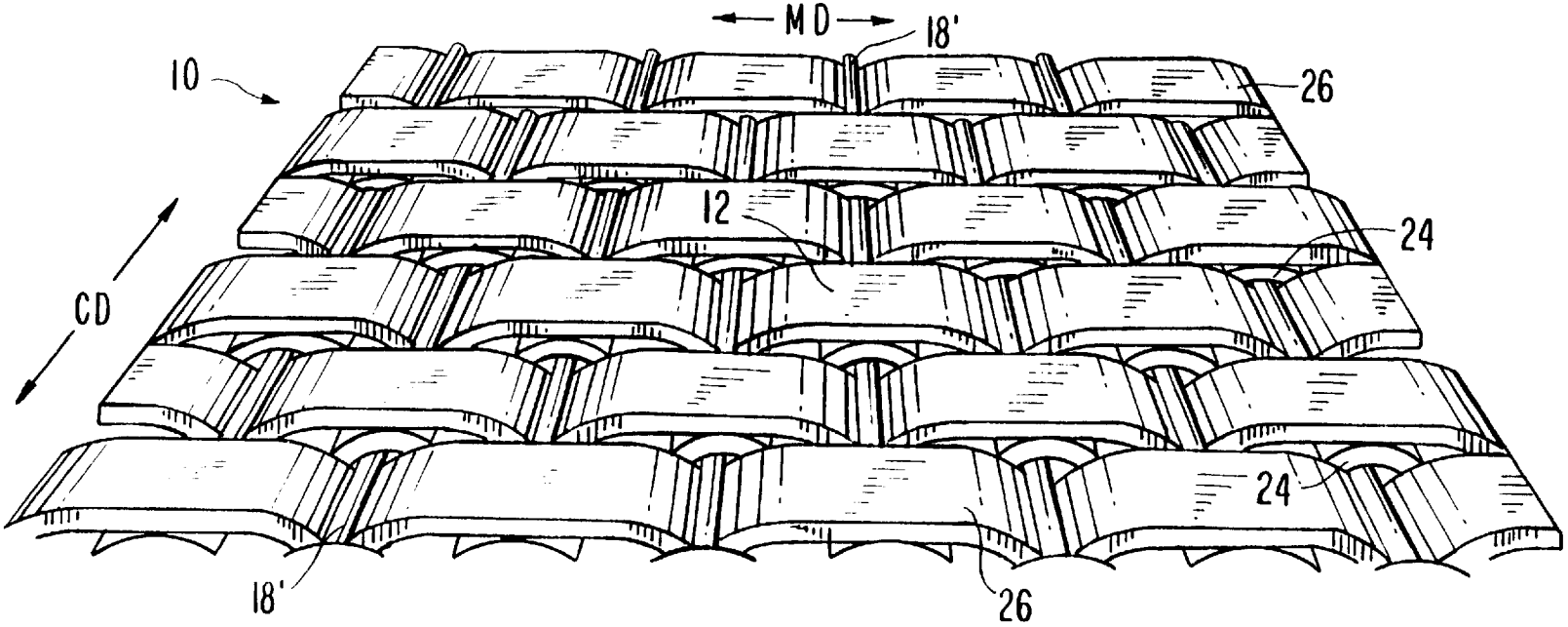
FIG. 2 is a perspective view of the upper surface of the papermakers' fabric.

FIG. 2 is a perspective view of the upper surface 12 of the papermakers' fabric 10, and shows a more realistic spacing between adjacent yarns of the fabric.

Figure 3:
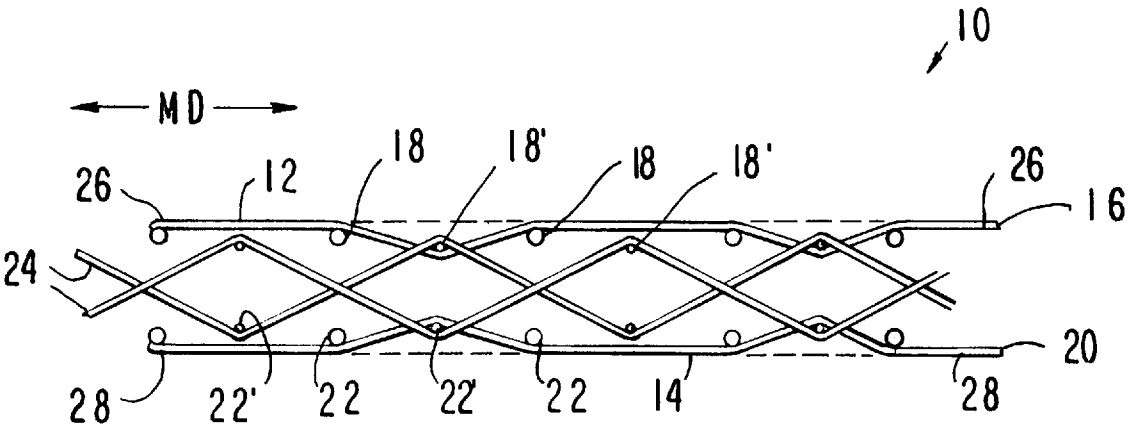
FIG. 3 is a cross-sectional view, taken in the machine direction as indicated by line 3—3 in FIG. 1, of the papermakers' fabric.

FIG. 3 is a cross-sectional view, taken as indicated by line 3—3 in FIG. 1. That is to say, FIG. 3 is a cross-sectional view taken in the machine direction through the cross-machine-direction (CD) yarns. It will be noted that fabric 10 includes two layers of CD yarns. A first layer 16 of CD yarns 18,18' is on the upper side of fabric 10, while a second layer 20, not visible in FIG. 1, of CD yarns 22,22' is on the lower side. It will be observed that CD yarns 18',22' are bound by MD yarns 24, while CD yarns 18,22 are not so bound. CD yarns 18,18' and CD yarns 22,22' may be provided in equal numbers, and, if so provided, may be in the vertically stacked, paired relationship shown in FIG. 3. That is to say, CD yarns 18,18' may be paired with and vertically stacked over CD yarns 22,22', respectively. Further, CD yarns 18,18',22,22' may be monofilament, multifilament or plied monofilament yarns of any of the synthetic polymeric resins used in the production of such yarns for paper machine clothing. Polyester and polyamide are but two examples of such materials. Other examples of such materials are polyphenylene sulfide (PPS), which is commercially available under the name RYTON®, and a modified heat-, hydrolysis- and contaminant-resistant polyester of the variety disclosed in commonly assigned U.S. Pat. No. 5,169,499, and used in dryer fabrics sold by Albany International Corp. under the trademark THERMONETICS®. The teachings of U.S. Pat. No. 5,169,499 are incorporated herein by reference.

Finally, CD yarns 18,18',22,22' may be of uniform thickness or diameter, or may be of more than one thickness or diameter. For example, CD yarns 18',22', which are bound by MD yarns 24, may be thinner or of smaller diameter than CD yarns 18,22, which are not so bound.

CD yarns 18',22' are interwoven by a first system of MD yarns 24. MD yarns 24 are monofilament yarns of either circular or rectangular cross section, although yarns of circular cross section are preferred. As above, MD yarns 24 may be of any of the synthetic polymeric resins used in the production of yarns for paper machine clothing. Polyester and polyamide are but two examples, along with the polyphenylene sulfide and modified heat-, hydrolysis- and contaminant-resistant polyester yarns described above.

MD yarns 24 interweave with CD yarns 18',22' in a duplex pattern, such as that shown in FIG. 3. A duplex pattern is one in which multiple layers of filling yarns are interwoven with a single system of warp yarns. An MD yarn 24, for example, may weave over one CD yarns 18'; between the next vertically stacked pair of CD yarns 18,22; under the next CD yarn 22'; between the next vertically stacked pair of CD yarns 18,22; and over the next CD yarn 18' to repeat the pattern.

The MD yarns in a second system of MD yarns may be either thicker or thinner than MD yarns 24 of the first system, or they may be equal in thickness to MD yarns 24. The second system of MD yarns comprises MD yarns 26 and MD yarns 28.

MD yarns 26,28 are monofilament yarns of either circular or rectangular cross section, although those of rectangular cross section are preferred. As before, MD yarns 26,28 may be of any of the synthetic polymeric resins used in the production of yarns for paper machine clothing. Polyester and polyamide are again but two examples, along with the polyphenylene sulfide and modified heat-, hydrolysis- and contaminant-resistant polyester yarns described above.

MD yarns 26 interweave with CD yarns 18,18' to form the upper surface 12 of the fabric 10, while MD yarns 28 interweave with CD yarns 22,22' to form the lower surface 14 of the fabric 10. The knuckles formed when the MD yarns 24 interweave with CD yarns 18',22' are within the surface planes defined by MD yarns 26,28, as indicated by the dashed lines in FIG. 3, when the weave pattern shown in the figures is used. MD yarns 24 are thereby protected from degradation by heat and abrasion. MD yarns 26,28 may be either thicker or thinner than MD yarns 24, or they (MD yarns 26,28) may be equal in thickness to MD yarns 24.

Preferably, MD yarns 24,26,28 are heat-, hydrolysis- and contaminant-resistant yarns.

MD yarns 26 are interwoven with CD yarns 18,18', and MD yarns 28 are interwoven with CD yarns 22,22' to give the fabric 10 smooth upper and lower surfaces 12,14. MD yarns 26 may weave over three consecutive CD yarns 18,18',18; under the next CD yarn 18'; and then over the next three consecutive CD yarns 18,18',18 to follow a repeating pattern. Similarly, MD yarns 28 may weave under three consecutive CD yarns 22,22',22; over the next CD yarn 22'; and then under the next three consecutive CD yarns 22,22', 22 to follow a repeating pattern that is a mirror image of that followed by MD yarn 26. MD yarns 24 weave over the CD yarns 18' under which MD yarns 26 weave. Similarly, MD yarns 24 weave under the CD yarns 22' over which MD yarns 28 weave.

MD yarns 26,28 may also be in a vertically stacked, paired relationship, as shown in FIG. 3 and suggested by FIG. 1. Such stacked pairs, however, will not be contiguous with, or adjacent to, one another, as they will be separated by at least one MD yarn 24 binding the first and second layers 16,20 together. Preferably, two MD yarns 24 are between each stacked pair of MD yarns 26,28.

Because stacked pairs of MD yarns 26,28 are not contiguous with, or adjacent to, one another, and because the knuckles formed when MD yarns 24 interweave with CD yarns 18',22' are within the surface planes defined by MD yarns 26,28, lengthwise channels are defined by, and are disposed between, MD yarns 26,28 on the upper and lower surfaces 12,14 of the fabric 10. The lengthwise channels are conducive to the handling of air on a paper making machine in their ability to channel it lengthwise therethrough and by providing void space for air to enter when the fabric 10 encounters and passes around a roll or cylinder on the machine.

Fabric 10 is typically flat-woven, in which case MD yarns 24,26,28 are warp yarns during the weaving process, and CD yarns 18,18',22,22' are weft yarns. Alternatively, a modified endless weaving process may be used to produce the fabric, in which case MD yarns 24,26,28 are weft yarns during the weaving process, and CD yarns 18,18',22,22' are warp yarns.

In either case, seaming loops are formed at the two ends of the fabric 10 for joining the fabric 10 into an endless loop during installation on a paper machine. This is accomplished by bringing the two ends of the fabric 10 together; by interdigitating the seaming loops at the two ends with one another across the width of the fabric 10; and by directing a seaming pin or pintle through the passage defined by the interdigitated seaming loops to lock the two ends of the fabric 10 together, thereby leaving it in the form of an endless loop.

In the present invention, MD yarns 24,26,28 in both the first and second systems of MD yarns are used to form seaming loops at the ends of the fabric 10. Where the fabric is flat-woven, the seaming loops are formed by looping MD yarns 24,26,28 at the ends of the fabric 10 and weaving the MD yarns 24,26,28 back into the fabric 10. If, on the other hand, the fabric 10 is woven by a modified endless weaving process, the seaming loops are formed by MD yarns 24,26, 28 during the weaving process itself by wrapping around a loop-forming yarn.

Figure 4:
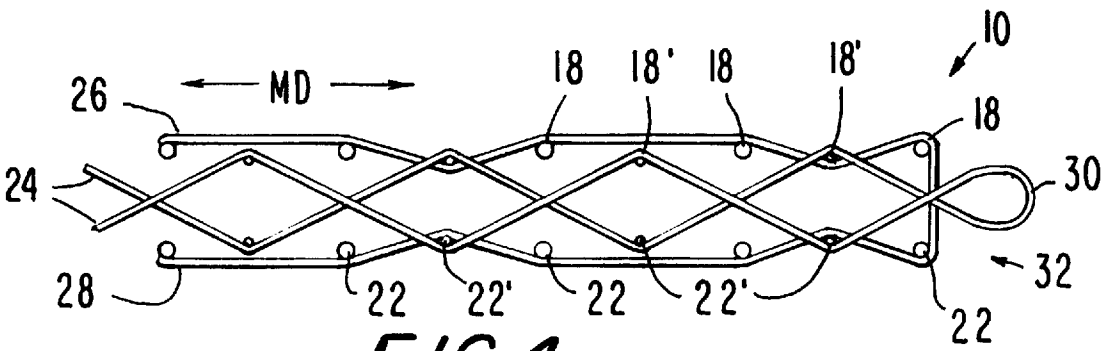
FIG. 4 through 9 are cross-sectional views taken in the machine direction in the same manner as that provided in FIG. 3 at one of the two ends of the fabric.

Turning back to the figures, FIG. 4 is a cross-sectional view taken in the same manner as FIG. 3 at one of the two ends of the fabric 10, and illustrating how a seaming loop 30 may be formed by MD yarn 24 at the end 32 of the fabric 10. After weaving over the CD yarn 18' closest to the end 32 of the fabric 10, MD yarn 24 passes between the last vertically stacked pair of CD yarns 18,22 at the end 32 of the fabric 10; forms seaming loop 30; passes back between the last vertically stacked pair of CD yarns 18,22 at the end 32 of the fabric 10; and weaves under the CD yarn 22' closest to the end 32 of the fabric 10, and back thereinto. MD yarn 26 weaves over and around the last CD yarn 18, and around and under the last CD yarn 22, at the end 32 of the fabric 10. In this light, it may be observed that MD yarn 28 is but a continuation of MD yarn 26 on the underside of the fabric 10.

Figure 5:
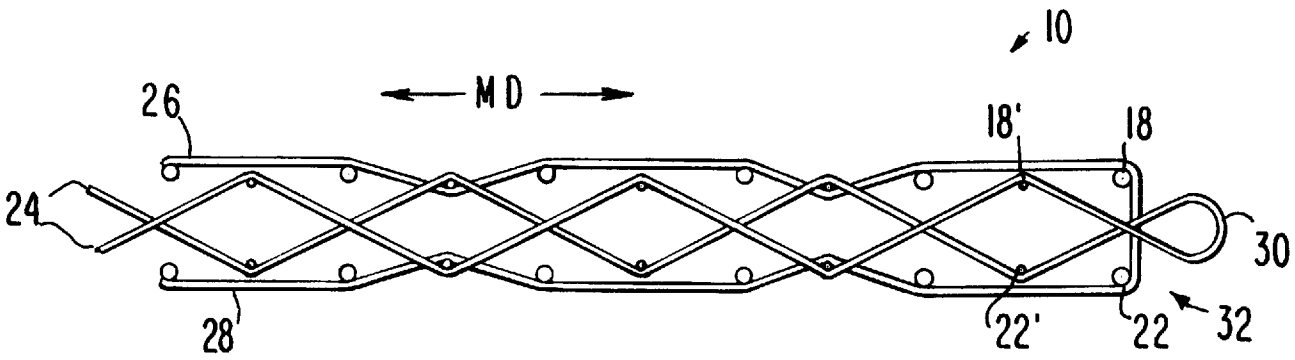

Because MD yarns 26,28 are woven in a staggered fashion, in the manner of a twill weave, some of the MD yarns 26,28 at the end 32 of the fabric 10 appear as shown in FIG. 5, which is also a cross-sectional view taken in the same manner as FIG. 3. The description of the paths taken by MD yarns 24,26,28 is the same as that in the preceding paragraph, although it will be noted that the CD yarns 18',22' closest to the end 32 of the fabric 10 are those which MD yarns 26,28 do not weave under or over, respectively.

Figure 6:
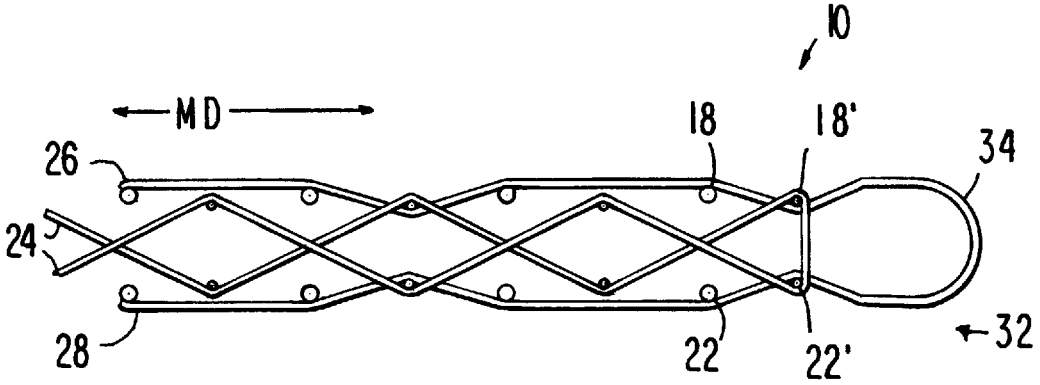

FIG. 6 is a cross-sectional view taken in the same manner as FIG. 3 at one of the two ends of the fabric 10, and illustrating how a seaming loop 34 may be formed from MD yarn 26 at the end 32 of the fabric 10. After weaving under the CD yarn 18' at the end 32 of the fabric 10, MD yarn 26 loops back and over the CD yarn 22' at the end 32 of the fabric 10 to form seaming loop 34. It may again be observed that MD yarn 28 is but a continuation of MD yarn 26 on the underside of the fabric 10. MD yarn 24 does not in this instance form a seaming loop, but weaves over and around the CD yarn 18', and around and under CD yarn 22', at the end 32 of the fabric 10, and back thereinto.

Figure 7:
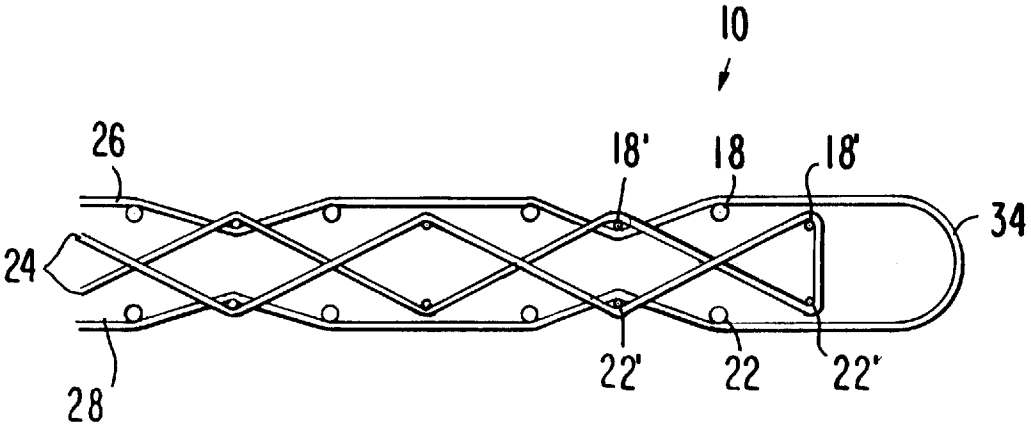

Again, because MD yarns 26,28 are woven in a staggered fashion, in the manner of a twill weave, some of the MD yarns 26,28 at the end 32 of the fabric 10 appear as shown in FIG. 7, which is also a cross-sectional view taken in the same manner as FIG. 3. After weaving under the second-to-last CD yarn 18' at the end 32 of the fabric 10, MD yarn 26 weaves over the last CD yarn 18 and the last CD yarn 18', MD yarn 26 loops back and under the last CD yarn 22' and the last CD yarn 22, and over the second-to-last CD yarn 22', at the end 32 of the fabric 10 to form seaming loop 34. MD yarn 28 may again be thought of as a continuation of MD yarn 26 on the underside of the fabric 10. MD yarn 24 does not in this instance form a seaming loop, but weaves over and around the CD yarn 18', and around and under the CD yarn 22', at the end 32 of the fabric 10, and back thereinto.

Figure 8:
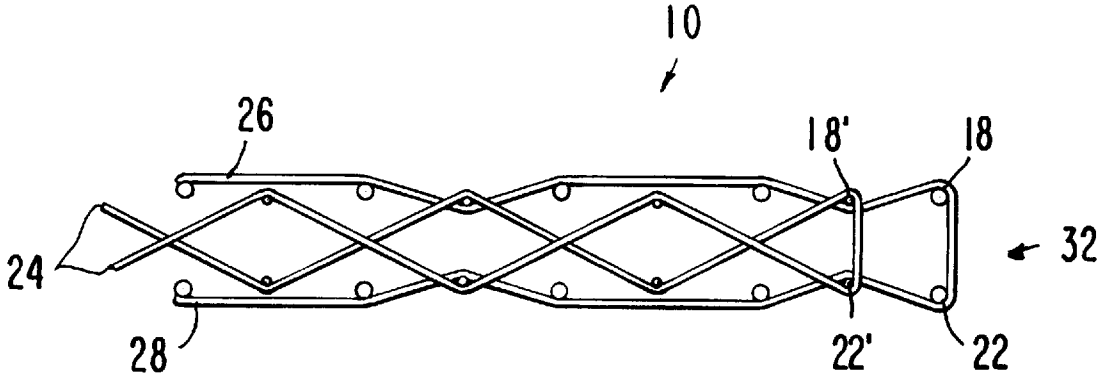

It may be appropriate that, at a given location on the end 32 of the fabric 10, none of MD yarns 24,26,28 forms a seaming loop 30,34. Such a situation is shown in FIG. 8, a cross-sectional view taken in the machine direction at the end 32 of the fabric 10. As seen above, MD yarn 24 in FIG. 8 weaves over and around the last CD yarn 18' and around and under the last CD yarn 22', at the end 32 of the fabric 10, and back thereinto. In a similar manner, MD yarn 26, after weaving under the last CD yarn 18' at the end 32 of the fabric 10, weaves over and around the last CD yarn 18, and around and under the last CD yarn 22, and over the last CD yarn 22', at the end 32 of the fabric 10, and back thereinto. As before, MD yarn 28 may be thought of as a continuation of MD yarn 26 on the underside of the fabric 10.

Figure 9:
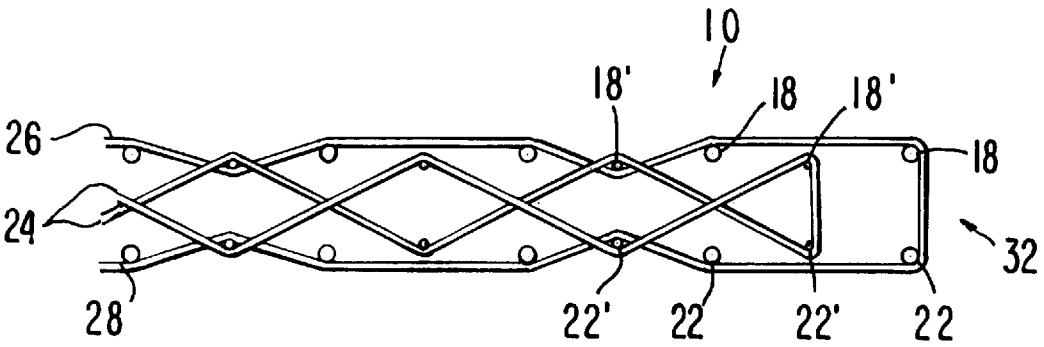

Again, because MD yarns 26,28 are woven in a staggered fashion, in the manner of a twill weave, the lack of a seaming loop formed by MD yarns 24,26,28 may also appear as shown in FIG. 9, also a cross-sectional view taken in the machine direction at the end 32 of the fabric 10. There, MD yarn 26 weaves under the second-to-last CD yarn 18'; over the second-to-last CD yarn 18 and the last CD yarn 18'; over and around the last CD yarn 18 and around and under the last CD yarn 22 at the end 32 of the fabric 10; under the last CD yarn 22' and the second-to-last CD yarn 22; and over the second-to-last CD yarn 22'; and back into the fabric 10. MD yarn 28 again may be thought of as a continuation of MD yarn 26 on the underside of the fabric 10. As before, MD yarn 24 in FIG. 9 weaves over and around the last CD yarn 18' and around and under the last CD yarn 22', at the end 32 of the fabric 10, and back thereinto.

Figure 10:
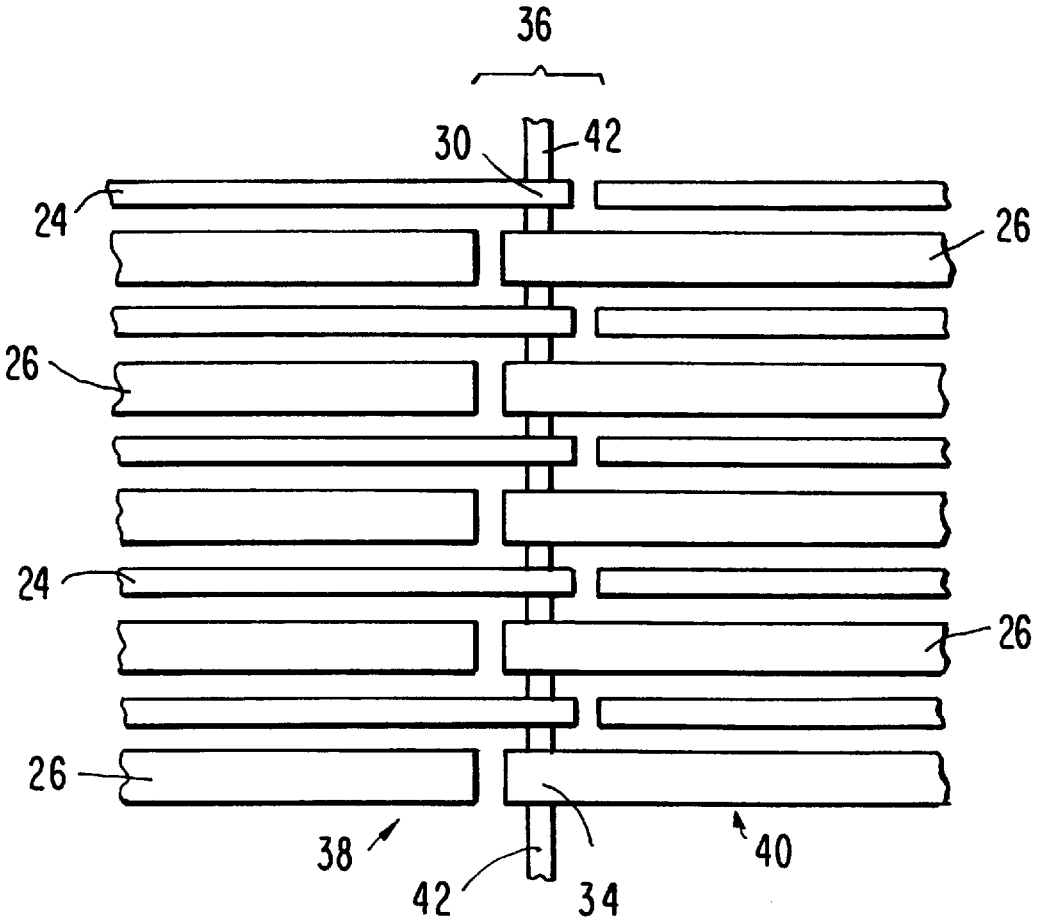
FIG. 10 is a schematic plan view of a first embodiment of the seam design of the present invention.

Having thus described the manner in which seaming loops 30,34 may be formed at an end 32 of the fabric 10 from MD yarns 24,26,28, or may not be formed at preselected locations there, FIG. 10 is a schematic plan view of a first embodiment of the seam design of the present invention for fabric 10. FIG. 10 shows a seam 36 formed by joining two ends 38,40 of the fabric 10 together. The schematic view shown in FIG. 10 of seam 36 would be the same when viewed from either side of the fabric 10. CD yarns 18,18', 22,22' are omitted from FIG. 10 for the sake of clarity.

End 38 includes seaming loops 30 formed from MD yarns 24 in the manner shown in FIGS. 4 and 5. MD yarns 26, assuming the upper surface 12 of fabric 10 is shown in FIG. 10, do not form seaming loops at end 38, but are turned back without doing so as shown in FIGS. 4 and 5.

End 40, however, includes seaming loops 34 formed from MD yarns 26 in the manner shown in FIGS. 6 and 7. MD yarns 24 do not form seaming loops at end 40, but are turned back without doing so as shown in FIGS. 6 and 7.

Seam 36 is formed, as previously described, by bringing ends 38,40 together; by interdigitating the seaming loops 30 at end 38 with the seaming loops 34 at end 40 with one another across the width of the fabric 10; and by directing a seaming pin or pintle 42 through the passage defined by the interdigitated seaming loops 30,34 to lock the two ends 38,40 of the fabric 10 together.

Figure 11:
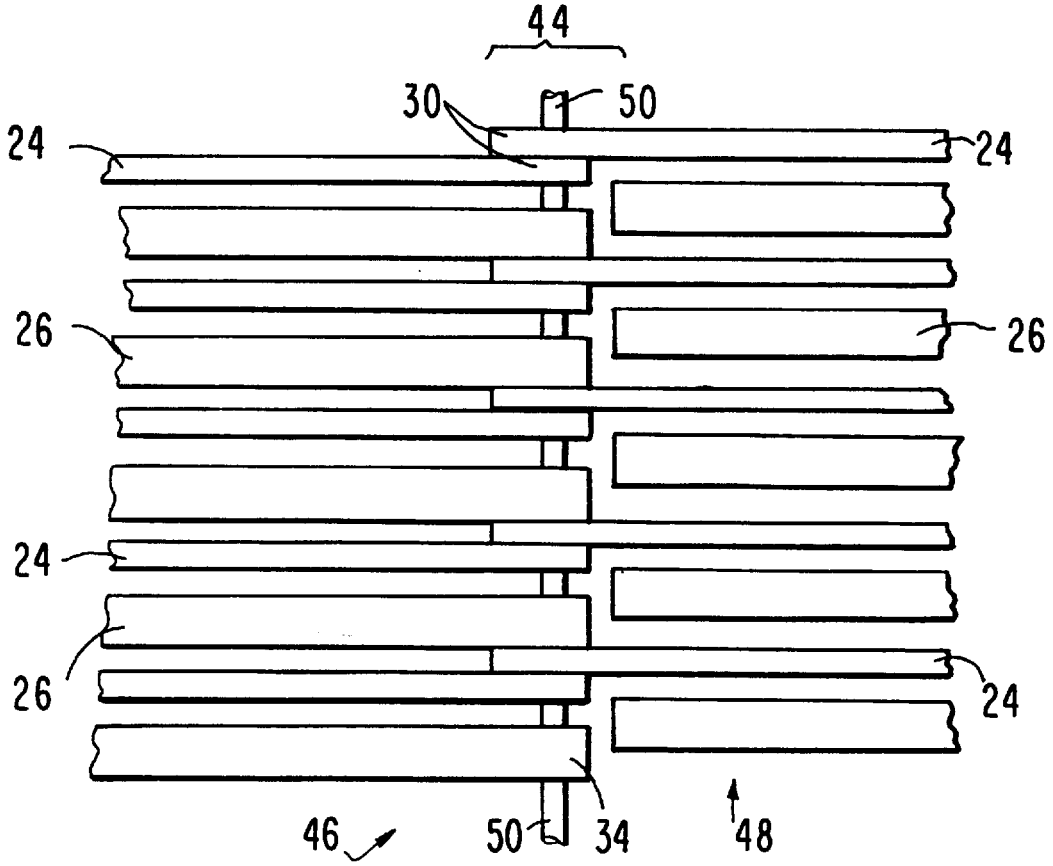
FIG. 11 is a schematic plan view of a second embodiment of the seam design.

FIG. 11 is a plan schematic view of a second embodiment of the seam design of the present invention. In FIG. 11, seam 44 is formed by joining two ends 46,48 of the fabric 10 together. As before, CD yarns 18,18',22,22' are omitted in the interest of clarity.

End 46 includes seaming loops 30,34 formed from MD yarns 24,26, respectively, in the manner shown in FIGS. 4 through 7. End 48 includes seaming loops 30 formed from MD yarns 24 in the manner shown in FIGS. 4 and 5. MD yarns 26 do not form seaming loops at end 48, but are turned back without doing so as shown in FIGS. 4 and 5.

Seam 44 is formed by bringing ends 46,48 together in the previously described manner, and by joining the two ends 46,48 together with pintle 50.

Figure 12:
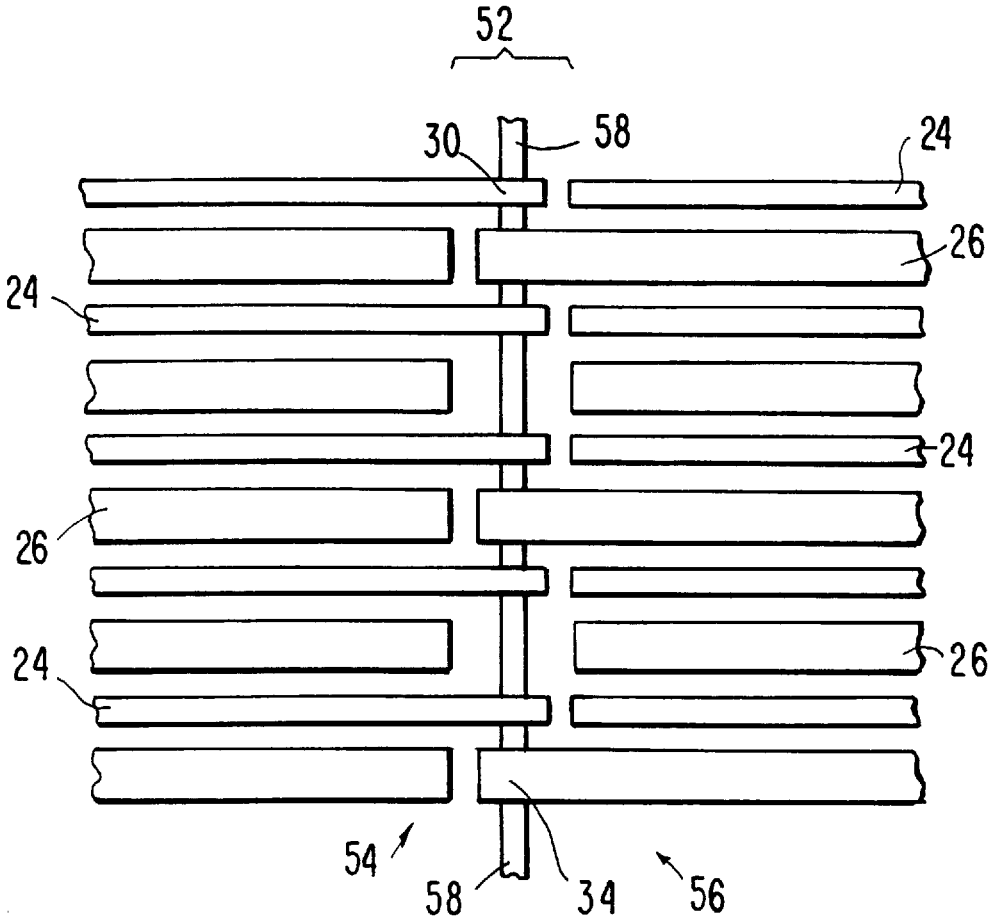
FIG. 12 is a schematic plan view of a third embodiment of the seam design.

FIG. 12 is a plan schematic view of a third embodiment of the seam design of the present invention. FIG. 12 shows a seam 52 formed by joining two ends 54,56 of the fabric 10 together. CD yarns 18,18',22,22' are again left out for the sake of clarity.

End 54 includes seaming loops 30 formed from MD yarns 24 in the manner shown in FIGS. 4 and 5. MD yarns 26 do not form seaming loops at end 54, but are turned back without doing so as shown in FIGS. 4 and 5.

End 56, however, includes seaming loops 34 formed by every other MD yarn 26 in the manner shown in FIGS. 6 or 7. MD yarns 24 do not form seaming loops at end 56. Nor do alternate MD yarns 26. MD yarns 24 and alternate MD yarns 26 are turned back without forming seaming loops as shown in FIGS. 8 and 9.

Seam 52 is formed by bringing ends 54,56 together in the previously described manner, and by joining the two ends 54,56 together with pintle 58.

It will be observed that, in each of the three seam designs, at least some of the seaming loops at one end of the fabric are formed by MD yarns 26,28 of the second system of MD yarns, while all of the seaming loops at the other end of the fabric are formed by MD yarns 24 of the first system of MD yarns.

The following is an example of a fabric 10 on which the present invention may be practiced.

EXAMPLE

A papermaker's fabric 10 was woven according to the weave pattern shown in FIGS. 1 through 3, and described above. MD yarns 26,28 were flat monofilament yarns of substantially rectangular cross section of dimensions 0.30 mm thick by 1.20 mm wide (0.012 inch by 0.047 inch; 12 mil by 47 mil), the width being on the upper and lower surfaces 12,14 of 20 the fabric 10. MD yarns 24 were monofilament yarns of circular cross section of diameter 0.50 mm (0.020 inch; 20 mil). It will be noted that MD yarns 24 were thicker than MD yarns 26,28. Nevertheless, as a consequence of the weave pattern used and illustrated herein, the knuckles formed where MD yarns 24 wrap over (or under) CD yarns 18',22' are within the surface planes defined by MD yarns 26,28.

CD yarns 18,22 were monofilament yarns of circular cross section of diameter 0.50 mm (0.020 inch; 20 mil), while CD yarns 18',22' were monofilament yarns of circular cross section of diameter 0.40 mm (0.016 inch; 16 mil). CD yarns 18,18' alternate with one another, and, likewise, CD yarns 22,22' alternate with one another. CD yarns 18 were paired with and vertically stacked over CD yarns 22; in like manner, CD yarns 18' were paired with and vertically stacked over CD yarns 22'. MD yarns 24 binded with CD yarns 18',22'.

The papermakers' fabric 10 of this example performed with good results when tested on the dryer section of a papermaking machine.

In the present papermakers' fabric, the seam presents less of a discontinuity on the surface of the fabric than that shown in the prior-art U.S. Pat. No. 5,503,196. There, the round MD monofilament yarns are used to form seaming loops at the ends of the fabric, and produce a seam which is an obvious gap on the surface of the fabric. In the present invention, the use of flat MD yarns to form seaming loops at one end of the fabric and of round MD yarns to form them at the other end provides a seam which is more planar with the fabric surface and less of a discontinuity on the fabric surface.

Modifications to the above would be obvious to those of ordinary skill in the art, but would not bring the invention so modified beyond the scope of the appended claims.

What is claimed is:

1. An on-machine-seamable papermakers' fabric for the forming, press and dryer sections of a paper machine, said fabric comprising:

a first layer and a second layer of cross-machine-direction (CD) yarns;

a first system of machine-direction (MD) yarns, said MD yarns of said first system being interwoven with selected CD yarns of said first and second layers in a duplex weave to bind said first and second layers together; and a second system of MD yarns, some of said MD yarns in said second system being interwoven with said CD yarns of said first layer and the remainder of said MD yarns in said second system being interwoven with said CD yarns of said second layer, said MD yarns of said second system defining upper and lower surfaces of said fabric; and said MD yarns of said first system and knuckles formed by the interweaving of said MD yarns of said first system with said selected CD yarns of said first and second layers residing within said fabric relative to said upper and lower surfaces, whereby said MD yarns of said first system are protected from heat and abrasion;

said on-machine-seamable papermakers' fabric having a first end and a second end joinable to said first end during installation of said fabric on a paper machine to place said fabric into the form of an endless loop; said first end having a plurality of first seaming loops formed by MD yarns of said first system of MD yarns and said second end having a plurality of second seaming loops formed by MD yarns of said second system of MD yarns, said first seaming loops at said first end being interdigitated with said second seaming loops at said second end, when said first and second ends are brought together on the paper machine, thereby defining a passage through which a pintle is directed to join said first and second ends together.

2. An on-machine-seamable papermakers' fabric as claimed in claim 1 wherein at least some of said MD yarns of said first system of MD yarns form first seaming loops at said first end of said fabric, and wherein each of said MD yarns of said second system of MD yarns interweaving with said CD yarns of said first layer forms a second seaming loop at said second end of said fabric.

3. An on-machine-seamable papermakers' fabric as claimed in claim 2 further comprising a plurality of first seaming loops formed by MD yarns of said first system of MD yarns at said second end of said fabric, said first seaming loops at said second end being interdigitated, along with said second seaming loops at said second end, with said first seaming loops at said first end when said first and second ends are brought together on the paper machine, thereby defining said passage through which a pintle is directed to join said first and second ends together.

4. An on-machine-seamable papermakers' fabric as claimed in claim 3 wherein at least some of said MD yarns of said first system of MD yarns form first seaming loops at said second end of said fabric.

5. An on-machine-seamable papermakers' fabric as claimed in claim 1 wherein at least some of said MD yarns of said first system of MD yarns form first seaming loops at said first end of said fabric, and wherein every other MD yarn of said second system of MD yarns interweaving with said CD yarns of said first layer forms a second seaming loop at said second end of said fabric.

6. An on-machine-seamable papermakers' fabric as claimed in claim 1 wherein at least some of said CD yarns are polyamide yarns.

7. An on-machine-seamable papermakers' fabric as claimed in claim 1 wherein at least some of said CD yarns are polyester yarns.

8. An on-machine-seamable papermakers' fabric as claimed in claim 1 wherein at least some of said CD yarns are polyphenylene sulfide yarns.

9. An on-machine-seamable papermakers' fabric as claimed in claim 1 wherein at least some of said CD yarns are modified heat- and hydrolysis-resistant polyester yarns.

10. An on-machine-seamable papermakers' fabric as claimed in claim 1 wherein at least some of said CD yarns are monofilament yarns.

11. An on-machine-seamable papermakers' fabric as claimed in claim 1 wherein at least some of said CD yarns are multifilament yarns.

12. An on-machine-seamable papermakers' fabric as claimed in claim 1 wherein at least some of said CD yarns are plied monofilament yarns.

13. An on-machine-seamable papermakers' fabric as claimed in claim 1 wherein there is one CD yarn in said first layer for every CD yarn in said second layer.

14. An on-machine-seamable papermakers' fabric as claimed in claim 13 wherein said CD yarns in said first layer are in a vertically stacked relationship with said CD yarns in said second layer, thereby forming stacked pairs.

15. An on-machine-seamable papermakers' fabric as claimed in claim 1 wherein said MD yarns in said first system are of circular cross section.

16. An on-machine-seamable papermakers' fabric as claimed in claim 1 wherein said MD yarns in said first system are of rectangular cross section.

17. An on-machine-seamable papermakers' fabric as claimed in claim 1 wherein said MD yarns in said first system are monofilament yarns.

18. An on-machine-seamable papermakers' fabric as claimed in claim 1 wherein at least some of said MD yarns in said first system are polyamide yarns.

19. An on-machine-seamable papermakers' fabric as claimed in claim 1 wherein at least some of said MD yarns in said first system are polyester yarns.

20. An on-machine-seamable papermakers' fabric as claimed in claim 1 wherein at least some of said MD yarns in said first system are polyphenylene sulfide yarns.

21. An on-machine-seamable papermakers' fabric as claimed in claim 1 wherein at least some of said MD yarns in said first system are modified heat- and hydrolysis-resistant polyester yarns.

22. An on-machine-seamable papermakers' fabric as claimed in claim 14 wherein each of said MD yarns in said first system weaves in a repeating pattern over a CD yarn in said first layer, between the next stacked pair of said CD yarns, under the next CD yarn in said second layer, between the next stacked pair of said CD yarns, and over the next CD yarn in said first layer to repeat said pattern.

23. An on-machine-seamable papermakers' fabric as claimed in claim 1 wherein said MD yarns of said second system are of circular cross section.

24. An on-machine-seamable papermakers' fabric as claimed in claim 1 wherein said MD yarns of said second system are of rectangular cross section.

25. An on-machine-seamable papermakers' fabric as claimed in claim 1 wherein said MD yarns of said second system are monofilament yarns.

26. An on-machine-seamable papermakers' fabric as claimed in claim 1 wherein at least some of said MD yarns of said second system are polyamide yarns.

27. An on-machine-seamable papermakers' fabric as claimed in claim 1 wherein said MD yarns of said second system are polyester yarns.

28. An on-machine-seamable papermakers' fabric as claimed in claim 1 wherein at least some of said MD yarns in said second system are polyphenylene sulfide yarns.

29. An on-machine-seamable papermakers' fabric as claimed in claim 1 wherein at least some of said MD yarns in said second system are modified heat- and hydrolysis-resistant polyester yarns.

30. An on-machine-seamable papermakers' fabric as claimed in claim 1 wherein each of said MD yarns in said second system interwoven with said CD yarns in said first layer weaves in a repeating pattern over three consecutive CD yarns in said first layer, under the next CD yarn in said first layer, and over the next three consecutive CD yarns in said first layer to repeat said pattern.

31. An on-machine-seamable papermakers' fabric as claimed in claim 1 wherein each of said MD yarns in said second system interwoven with said CD yarns in said second layer weaves in a repeating pattern over a CD yarns in said second layer, under the next three consecutive CD yarns in said second layer, and over the next CD yarn in said second layer to repeat said pattern.

32. An on-machine-seamable papermakers' fabric as claimed in claim 1 wherein said MD yarns in said second system of MD yarns are in vertically stacked pairs, one MD yarn in each of said pairs being interwoven with said CD yarns in said first layer, and the other MD yarn in each of said pairs being interwoven with said CD yarns in said second layer.

33. An on-machine-seamable papermakers' fabric as claimed in claim 32 wherein there are two MD yarns of said first system of MD yarns between each vertically stacked pair of said MD yarns of said second system of MD yarns.

34. An on-machine-seamable papermakers' fabric as claimed in claim 1 wherein said MD yarns of said second system are thicker than said MD yarns of said first system.

35. An on-machine-seamable papermakers' fabric as claimed in claim 1 wherein said MD yarns of said second system are thinner than said MD yarns of said first system.

36. An on-machine-seamable papermakers' fabric as claimed in claim 1 wherein said MD yarns of said second system are of the same thickness as said MD yarns of said first system.

37. An on-machine-seamable papermakers' fabric as claimed in claim 1 wherein said MD yarns of said first system are monofilament yarns of circular cross section, and said MD yarns of said second system are monofilament yarns of rectangular cross section.

38. An on-machine-seamable papermakers' fabric as claimed in claim 1 wherein said MD yarns of said second system define lengthwise channels therebetween on said upper and lower surfaces of said fabric as a consequence of said MD yarns of said first system interweaving with said selected CD yarns in said first layer below said upper surface of said fabric, and with said selected CD yarns in said second layer above said lower surface of said fabric.

* * * * *